US005455735A

United States Patent [19]

Zerega

[11] Patent Number: 5,455,735

[45] Date of Patent: Oct. 3, 1995

[54] SAFETY SWITCHING DEVICE FOR USE WITH POWER EQUIPMENT

[76] Inventor: James Zerega, 16905 Olde Mill Run, Rockville, Md. 20855

[21] Appl. No.: 163,740

[22] Filed: Dec. 7, 1993

[51] Int. Cl.[6] ..... H01H 47/00

[52] U.S. Cl. ..... 361/189; 307/139

[58] Field of Search ..... 361/139, 160, 361/166, 170, 167, 187, 189, 191, 192; 307/112, 113, 116, 119, 125, 132 R, 139, 140, 141

[56] References Cited

U.S. PATENT DOCUMENTS

| | | | |
|---|---|---|---|
| 3,371,254 | 2/1968 | Hagfors . | |
| 3,636,375 | 1/1972 | Armstrong . | |
| 4,048,666 | 9/1977 | Irie et al. . | |
| 4,068,274 | 1/1978 | Murphy, Jr. et al. . | |
| 4,366,366 | 12/1982 | Ekblad | 361/195 |
| 4,371,118 | 2/1983 | Sontheimer et al. | 361/203 |

*Primary Examiner*—Jeffrey A. Gaffin
*Attorney, Agent, or Firm*—Robert E. Bushnell

[57] ABSTRACT

A safety switching device for quickly prohibiting a power source from operating a piece of power equipment and for keeping the power equipment in a stopped state until a manual spring loaded start switch on the safety switching device is depressed. An electromagnetic switch in the safety switching device is arranged to open an AC power circuit to separate the power source from the piece of power equipment in case of power failure, a plug of the high voltage line is pulled from its outlet, an on/off activator switch is switched off or a manual spring loaded stop switch in the safety switching device is depressed. The safety switching device also includes a power convertor connected to the power source by an AC power cord and the on/off activator switch. The power convertor converts an AC voltage a DC voltage for energizing the electromagnetic switch and an electromagnet in a DC circuit of the safety switching device. The electromagnet holds the start switch in an "on" position until AC power is lost or the stop switch is depressed.

10 Claims, 1 Drawing Sheet

SAFETY SWITCHING DEVICE FOR USE WITH POWER EQUIPMENT

BACKGROUND OF THE INVENTION

1. Field of the Invention

The present invention relates to a safety switching device for use with power equipment, such as power tools. An operator of such power equipment may unplug or remove the power source from the power equipment without turning the power equipment off directly. This removal of the power source could be caused accidently or otherwise; however, when the operator plugs the equipment back in or returns power to the equipment by other than the on/off switch of that piece of equipment, a hazardous situation exists. This is because the equipment may restart unexpectedly. Accordingly, use of the present invention with a power equipment prevents the hazardous situation from occurring.

2. Description of the Prior Art

The Electric safety Switch Circuitry described by Yutaka Irie et al. in U.S. Pat. No. 4,048,666 discusses an ON/OFF switch located between a power source and a transformer and the ON/OFF switch connected in a low voltage circuit after the transformer. An OFF switch is normally closed and an ON switch is normally open. Depressing the ON switch will cause the low voltage circuit to be complete thereby activating a relay. The relay will cause several switches to close thus providing high voltage to power equipment. Further, the relay causes another switch to close in order to maintain the low voltage circuit in a conducting mode. Once power is removed from the system or the OFF switch is depressed the relay will no longer receive a low voltage, and each of the switches will open their respective circuits. Once power is restored to the circuit the relay will not close the switches again until an the switch is again depressed, to thereby re-energize the power equipment. Further provide safety switches are responsive to abnormal conditions being monitored in the power equipment.

The Safety Control System described by Harold T. Hagfors in U.S. Pat. No. 3,371,254, the *Magnetic Loom-Brakin Device* discussed in U.S. Pat. No. 3,636,375 to Stanley E. Armstrong, and the *Magnetic Switch and Circuitry for Safety Shut Down of Power Equipment* depicted in U.S. Pat. No. 4,068,274 to Frank W. Murphy, Jr. et al. are representative of other known arrangements using safety electromagnetic switches to control equipment.

SUMMARY OF THE INVENTION

The inventive safety switching device includes an AC power cord connected to provide power to an activator (on/off) switch. The activator switch enables power to be supplied to an AC to DC power convertor for conversion to a low DC voltage. An electromagnetic switch is responsive to the DC voltage generated by the power convertor. A spring loaded start button and a spring loaded stop button comprise a manual start/stop switch situated between the power convertor and the electromagnetic switch wherein the manual start button closes the circuit between the power convertor and the electromagnetic switch, and an electromagnet connected between the power convertor and the electromagnetic switch is activated to hold the manual start/stop switch in an on state. The closing of the DC circuit activates the electromagnetic switch to complete an AC circuit to enable power to be supplied from said AC power cord to an AC outlet. Depressing the stop button will open the DC circuit which in turn cuts off DC voltage to the electromagnetic switch thereby opening the AC circuit to prevent AC power from being supplied to the AC outlet. The electromagnet also loses power and no longer holds the DC circuit closed thereby insuring that AC power is not supplied to the AC outlet so that equipment plugged into the AC outlet is prevented from restarting until the start button is again depressed to close the DC circuit.

Further, if the AC power cord is disconnected from an AC power source the power convertor will no longer generate a DC voltage and the electromagnetic switch will open the AC circuit to prevent AC power from being supplied to the AC outlet. The electromagnet also loses power and no longer holds the DC circuit closed thereby insuring that AC power, when the AC power cord is again connected to the AC power source, is not supplied to the AC outlet so that equipment plugged into AC outlet is prevented from restarting until the start button is again depressed to close the DC circuit to enable the electromagnetic switch to again close the AC circuit.

The inventive safety switching device is housed in a metal or plastic case having a pair of magnets situated so as to be able to mount the safety switching device on the equipment plugged into the safety switching device's AC outlet. The case also comprises a pair of mounting holes therein for use with fasteners for mounting the safety switching device when the use of the magnets is not possible or practical.

DESCRIPTION OF THE PREFERRED EMBODIMENT

Figure 1:
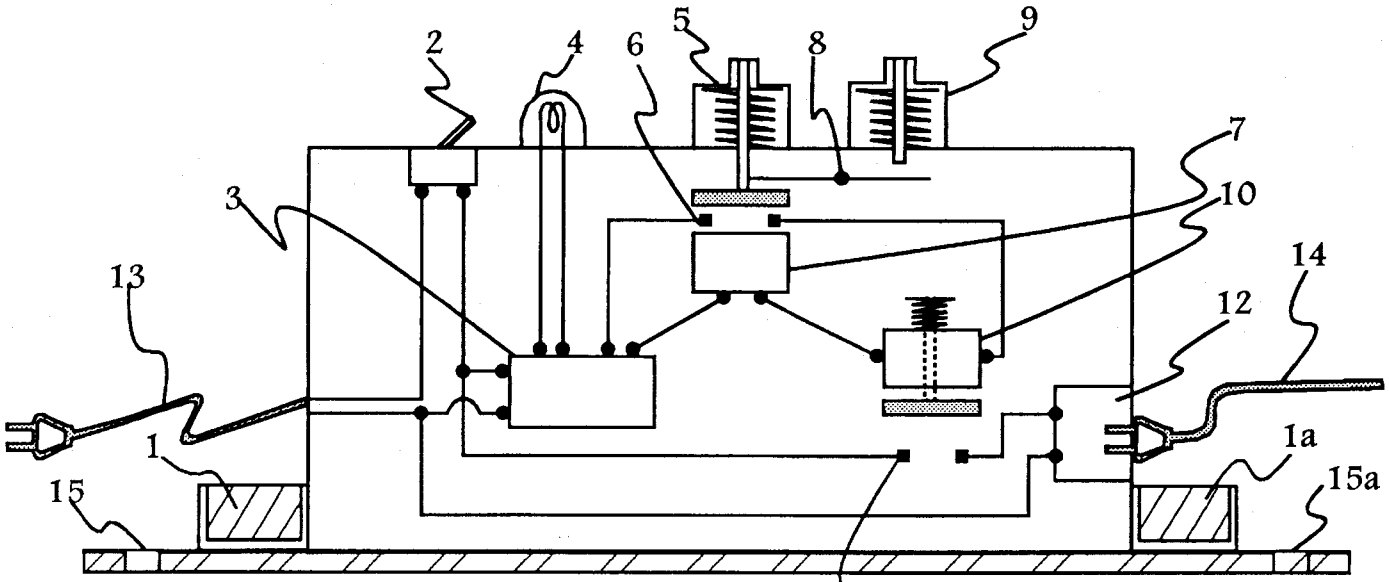
FIG. 1 is illustrative of the various components of the safety switching device and their interconnections.
Figure 2:
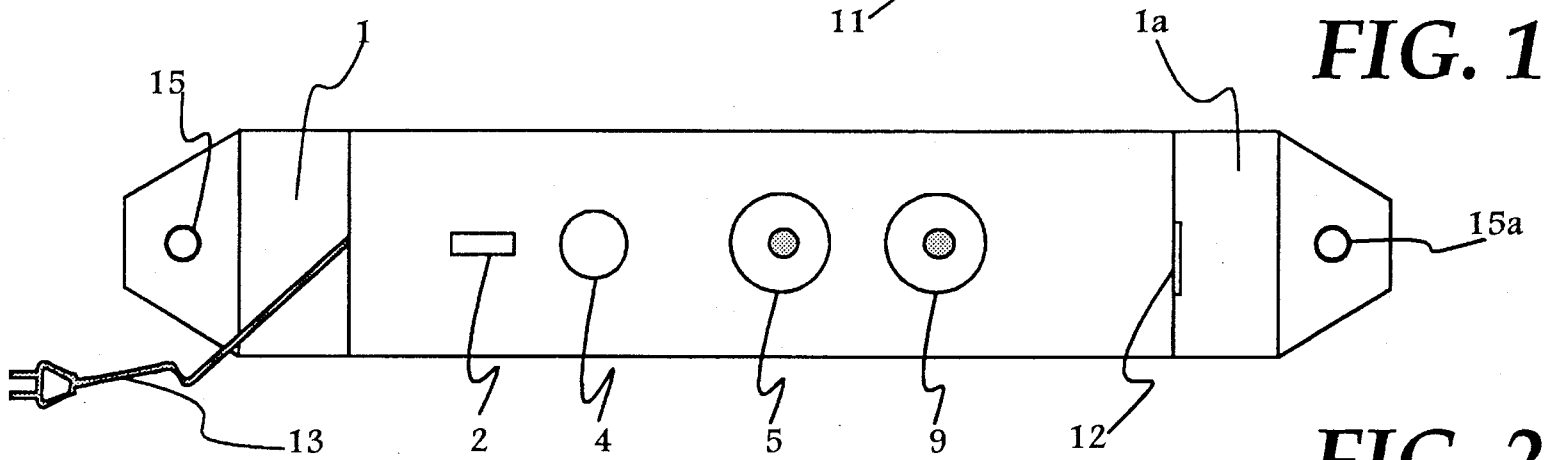
FIG. 2 is a top view of the encased safety switching device.

Irie et al., U.S. Pat. No. 4,048,666 shows in FIG. 2 an ON/OFF switch (Sm-A, Sm-B) located between the power source and the transformer (PT) whereas FIG. 3 shows the ON/OFF switch connected in the low voltage circuit (LVC) after the transformer. In FIG. 3 OFF switch Sm-B is normally closed and ON switch Sm-A is normally open. The depressing of the ON switch will cause the low voltage circuit to be complete thereby activating relay (Ry). Relay (Ry) will cause switches 1*a*1 and 1*a*2 to close thus providing the high voltage to the power equipment. Further, the relay causes switch 1*a*3 to close (once Sm-A is released it returns to the normally open position) thereby maintaining the low voltage circuit to conduct. Once power is removed from the system or OFF switch (Sm-B) is depressed the relay will no longer receive a low voltage, and switches 1*a*1, 1*a*2 and 1*a*3 will open their respective circuits. Once power is restored to the circuit relay (Ry) will not close switches 1*a*1, 1*a*2 and 1*a*3 again until ON switch (Sm-A) is again depressed, to thereby re-energize the power equipment. Switches S1 . . . Sn and $T_b$ are further safety switches responsive to abnormal conditions being monitored in the power equipment. However, Irie, et al's. electric safety switch is an integral part of the power equipment and can not be disconnected therefrom and connected to another piece of equipment.

The inventive safety switching device is capable of being disconnected and connected with any piece of power equipment one may desire to operate, such equipment being equipped with an AC power cord for attachment to an AC outlet. The safety switching device includes an AC power cord 13 connected to provide power to an activator (on/off) switch 2. The activator switch 2 enables power to be supplied to an AC to DC power convertor 3 for conversion to a low DC voltage. An electromagnetic switch 11, which is comprised of a solenoid, is responsive to the DC voltage generated by the power convertor 3. At this time, the low DC voltage is supplied to a light bulb 4 which lights up to indicate that AC power has been supplied to the power convertor 3. A spring loaded start button 5 and a spring loaded stop button 9 comprise a manual start/stop switch situated between the power convertor 3 and the electromagnetic switch 10. When the manual start button 5 is depressed it closes and completes the DC circuit at contact point 6 between the power convertor 3 and the electromagnetic switch 10. An electromagnet 7, located at contact point 6 and connected between the power convertor 3 and the electromagnetic switch 10 is activated, when the DC circuit is closed, to hold the manual start/stop switch in an on state. The closing of the DC circuit activates the electromagnetic switch 10 to complete an AC circuit at contact point 11 to enable power to be supplied from said AC power cord 13 to an AC outlet 12. Depressing the stop button 9 will cause a pivot lever 8 to break the connection at contact point 6 thereby opening the DC circuit. The open DC circuit cuts off DC voltage to the electromagnetic switch 10 thereby breaking the connection at contact point 11 thus opening the AC circuit to prevent AC power from being supplied to the AC outlet 12. The electromagnet 7 also loses power and is no longer enabled to hold the DC circuit closed thereby insuring that AC power is not supplied to the AC outlet 12. Equipment plugged into the AC outlet 12 is prevented from restarting until the start button 5 is again depressed to close the DC circuit. AC power to the AC outlet 12 is also cut off, as described above, when either a plug attached to the AC power cord 13 is disconnected from an AC power source, when there is a power failure or when the activator switch 2 is switched to the off state.

If the AC power cord 13 is disconnected from an AC power source or the activator switch 2 is switched to the off state, the power convertor 3 will no longer generate a DC voltage and the electromagnetic switch 10 will open the AC circuit to prevent AC power from being supplied to the AC outlet 12. The electromagnet 7 also loses power and no longer holds the DC circuit closed thereby insuring that AC power, when the AC power cord is again connected to the AC power source or the activator switch 2 is returned to the on state, is not supplied to the AC outlet 12 so that equipment plugged into AC outlet 12 is prevented from restarting until the start button 5 is again depressed to close the DC circuit to enable the electromagnetic switch 10 to again close the AC circuit.

The inventive safety switching device is housed in a metal or plastic case having a pair of tabs having a pair of magnets 1 and 1*a* situated so as to be able to mount the safety switching device on the equipment plugged into the safety switching device's AC outlet 12. The case also comprises a pair of mounting holes 15 and 15*a* in said tabs, for use with fasteners, for mounting the safety switching device when the use of the magnets is not possible or practical.

What is claimed is:

1. A safety switching device comprising:

an AC power cord for connecting said safety switching device to an AC power source for providing said safety switching device with an AC voltage;

an AC outlet provided as a receptacle for use by a piece of power equipment;

an AC circuit for providing an AC voltage to said AC outlet, said AC circuit having a first open contact point;

an AC to DC power convertor for generating a DC voltage in response to said AC voltage;

an activator switch for enabling said AC voltage to be supplied to said AC to DC power convertor when said activator switch set to an on state;

a DC circuit to receive said DC voltage generated by said AC to DC power convertor, said DC circuit having a second open contact point;

a spring loaded start button for providing means for contacting said second open contact point to cause said DC circuit to form a completed DC circuit when said spring loaded start button is depressed;

electromagnetic switching means connected to said DC circuit for providing means for contacting said first open contact point to cause said AC circuit to form a completed AC circuit when said DC voltage generated by said AC to DC power convertor is supplied to said electromagnetic switching means; and an electromagnet connected to said DC circuit and enabled by said DC voltage for holding said DC circuit in the completed state.

2. The safety switching device as set forth in claim 1, further comprising:

a pivotable lever connected to said means provided by said spring loaded start button; and a spring loaded stop button providing means for contacting said pivotal lever, when said spring loaded stop button is depressed, for causing said means provided by said spring loaded start button to break contact with said second open contact point.

3. The safety switching device as set forth in claim 2, further comprising:

said electromagnet being disabled and prohibited from holding said DC circuit in the completed state when said AC to DC power convertor fails to generate said DC voltage due to said AC power cord being disconnected from said AC power source, said activator switch being set to an off state, said spring loaded stop switch being depressed or said power source failing to provide an AC voltage due to a power failure;

said electromagnetic switching means being disabled when said DC circuit is not in said completed state;

said AC circuit being set in a open state when said electromagnetic switching means is disabled; and said AC outlet being prohibited from supplying an output AC voltage to said power equipment when said Ac circuit is set in said open state.

4. The safety switching device as set forth in claim 2, further comprising:

said electromagnetic switching means being disabled when said spring loaded stop button is depressed, for causing said means provided by said spring loaded start button to break contact with said second open contact point;

said AC circuit being set in a open state when said electromagnetic switching means is disabled; and said AC outlet being prohibited from supplying an output AC voltage to said power equipment when said AC circuit is set in said open state.

5. The safety switching device as set forth in claim 1, further comprising a light bulb connected to said AC to DC power convertor for indicating when said DC voltage is generated by said AC to DC power convertor.

6. The safety switching device as set forth in claim 1, wherein said electromagnetic switching means comprises a solenoid, said solenoid being enabled in response to said DC voltage when said spring loaded start switch is depressed.

7. The safety switching device as set forth in claim 1, further comprising:

said electromagnet being disabled and prohibited from holding said DC circuit in the completed state when said AC to DC power convertor fails to generate said DC voltage due to said AC power cord being disconnected from said AC power source, said activator switch being set to an off state or said power source failing to provide an AC voltage due to a power failure;

said electromagnetic switching means being disabled when said DC circuit is not in said completed state;

said AC circuit being set in a open state when said electromagnetic switching means is disabled; and said AC outlet being prohibited from supplying an output AC voltage to said power equipment, if said AC power cord is reconnected to said AC power source, said activator switch is reset to said on state or said power source again provides an AC voltage, until said spring loaded start button is again depressed.

8. The safety switching device as set forth in claim 1, further comprising:

means for housing said safety switching circuit, said housing means having first and second mounting tabs, each tab having a mounting hole therein for enabling said housing means to be attached to said power equipment; and a first magnet mounted on the first tab and a second magnet mounted on the second tab, for magnetically attaching said housing means to said power equipment.

9. A safety switching device having an AC power cord for connecting said safety switching device to an AC power source for providing said safety switching device with an AC voltage, and an AC outlet provided as a receptacle for use by a piece of power equipment, said safety switching device comprising:

on/off switch means for controlling input of an AC voltage to an AC to DC power convertor;

said AC to DC power convertor for generating a DC voltage in response to said AC voltage;

an open DC circuit for receiving said DC voltage generated by said AC to DC power convertor, said open DC circuit having first means for enabling said open DC circuit to be converted to a closed DC circuit;

a spring loaded start button providing second means for contacting said first means to close said open DC circuit to form said closed DC circuit when said spring loaded start button is depressed;

a pivotable lever connected to said second means;

a spring loaded stop button providing third means for contacting said pivotal lever, when said spring loaded stop button is depressed, for causing said second means to break contact with said second open contact point;

an open AC circuit for receiving said AC voltage provided by said on/off switch when said on/off switch is set to an on position, said open AC circuit having fourth means for enabling said open AC circuit to be converted to a closed AC circuit;

electromagnetic switching means connected to receive said DC voltage, when said open DC circuit is converted to said closed DC circuit, for providing fifth means to contact said fourth means to close said open AC circuit to enable said AC voltage to be supplied from said on/off switch to said AC outlet; and an electromagnet connected to receive said DC voltage, when said open DC circuit is converted to said closed DC circuit, for holding said second means in contact with said first means until said on/off switch is set to an off position or until said spring loaded stop switch is depressed.

10. The safety switching device as claimed in claim 9, wherein said electromagnetic switching means comprises a solenoid for extending said fifth means to maintain contact with said fourth means until said DC voltage is no longer received by said electromagnetic switching means.

* * * * *